US006293721B1

(12) United States Patent
Bow et al.

(10) Patent No.: US 6,293,721 B1
(45) **Date of Patent: *Sep. 25, 2001**

(54) PRONGED CARRIER FOR HOLDING AND RETAINING A POMADE

(75) Inventors: Clark Bow, Dandridge, TN (US); Gary Myer, Somerville, NJ (US)

(73) Assignee: Cosmair Cosmetics Corp., Clark, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/076,064

(22) Filed: May 12, 1998

(51) Int. Cl.[7] ..... A45D 40/06; A45D 40/20
(52) U.S. Cl. ..... 401/78; 401/87; 401/88
(58) Field of Search ..... 401/78, 75, 68, 401/87, 88

(56) References Cited

U.S. PATENT DOCUMENTS

| | | | | |
|---|---|---|---|---|
| 1,520,430 | | 12/1924 | Noble . | |
| 1,646,005 | | 10/1927 | Baquey . | |
| 2,318,152 | * | 5/1943 | Gelardin | 401/78 |
| 2,351,395 | * | 6/1944 | Broder | 401/78 |
| 2,469,631 | | 5/1949 | Broder . | |
| 3,531,212 | * | 9/1970 | Landen | 401/75 X |
| 3,771,881 | | 11/1973 | Swenson . | |
| 4,208,144 | | 6/1980 | Idec et al. . | |
| 4,820,070 | | 4/1989 | Spatz | 401/87 |
| 4,983,059 | | 1/1991 | Holloway . | |
| 5,186,561 | | 2/1993 | Ackermann et al. . | |
| 5,236,270 | | 8/1993 | Kageyama et al. . | |
| 5,277,508 | | 1/1994 | Gueret | 401/87 |
| 5,324,125 | | 6/1994 | Ackermann . | |
| 5,340,225 | | 8/1994 | Chevassus . | |
| 5,399,040 | | 3/1995 | Holloway . | |
| 5,609,430 | * | 3/1997 | Mazzola et al. | 401/78 X |
| 5,662,425 | * | 9/1997 | Mitsuya | 401/68 |
| 5,888,004 | * | 3/1999 | Bouix | 401/87 |

FOREIGN PATENT DOCUMENTS

| | | |
|---|---|---|
| 43 40 067 | 5/1994 | (DE) . |
| 0 815 766 | 1/1998 | (EP) . |
| 429845 | 6/1935 | (GB) . |
| 731013 | 6/1955 | (GB) . |
| 2 143 212 | 2/1985 | (GB) . |

* cited by examiner

*Primary Examiner*—Gregory L. Huson
*Assistant Examiner*—Kathleen J. Prunner
(74) *Attorney, Agent, or Firm*—Oblon, Spivak, McClelland, Maier & Neustadt, P.C.

(57) ABSTRACT

A pronged carrier for a cosmetic pomade is provided for use in a cosmetic dispenser such as a lipstick dispenser. The pomade carrier is made of a platform with at least two spikelike blades that project from the surface of the platform. The blades have two blade members and, in a preferred arrangement, one blade member is disposed adjacent to the peripheral edge of the platform and the second blade member is angled toward the center of the platform. When a pomade is placed onto the carrier, the cooperative action of the blade members of the blades secure the pomade on the carrier.

30 Claims, 4 Drawing Sheets

FIG_1
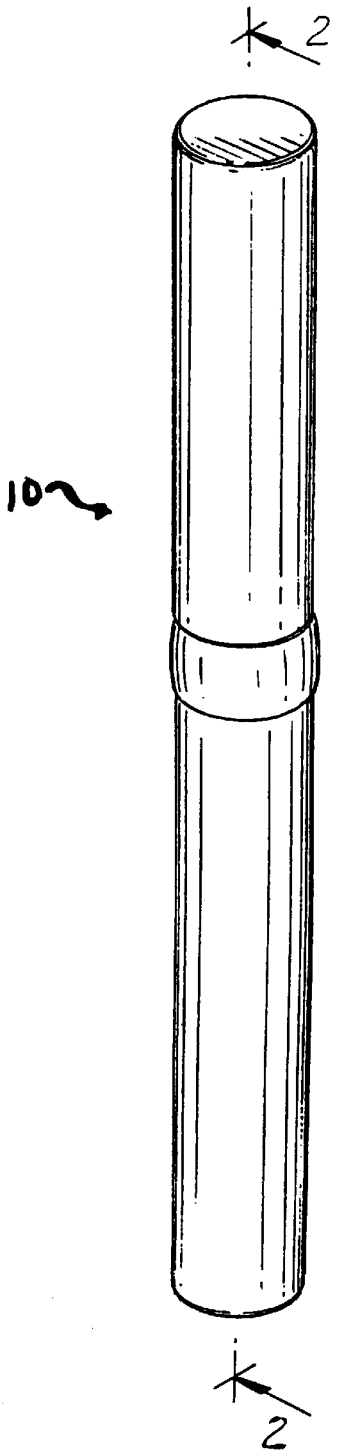
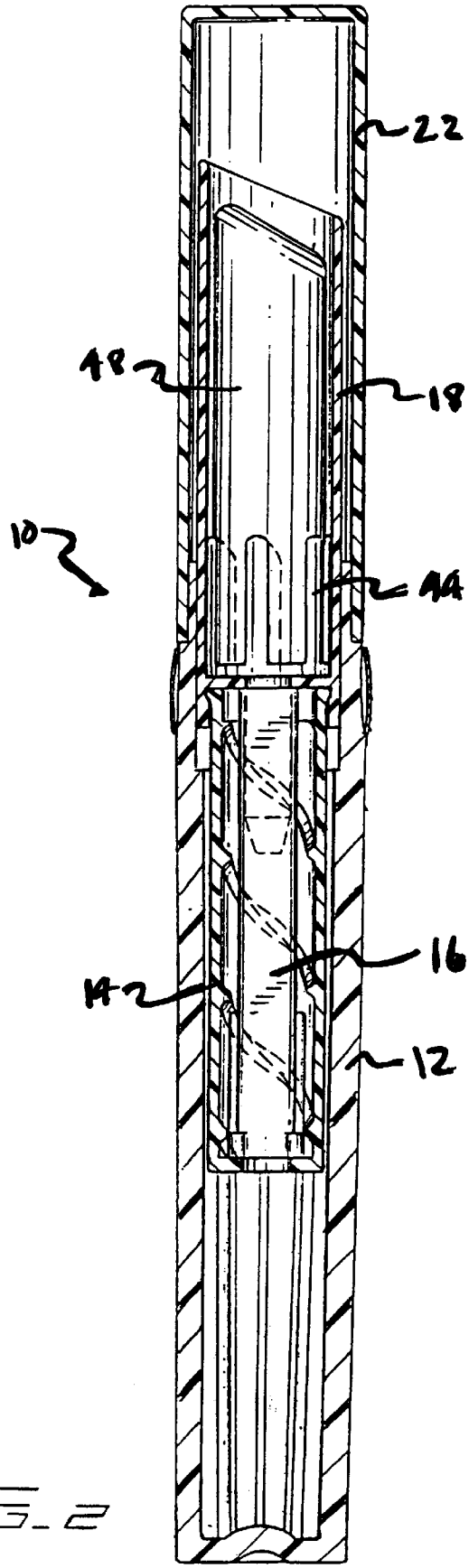
FIG_2

PRONGED CARRIER FOR HOLDING AND RETAINING A POMADE

BACKGROUND OF THE INVENTION

1. Field of the Invention

The present invention relates to dispensers for solid pasty materials such as cosmetic pomades and more particularly to carriers designed to facilitate insertion and retention of a solid pomade within the dispenser.

2. Description of the Related Art

Cosmetic products such as lipsticks, concealer sticks and lip balms, are typically marketed in dispensers that contain the cosmetic as a pomade or bullet mounted in a cup that is moved up and down along a track within a cylindrical sleeve to extend and retract the cosmetic for use. The pomade is loaded into the cup either automatically or manually. Typically, with manual filling, stick-shaped pomades are pre-formed in a mold, chilled and pressed into the cup holder of the dispenser by hand. With a popular-type of automatic filling, the pomades are molded upside-down in a continuous process, chilled, and then ejected out of the mold into the cup of the lipstick dispenser. For automatic filling, the pomade is formed into a bullet or cylindrical shape having a constant diameter throughout the length. Frictional forces between the pomade and the inside wall of the cup holder work to retain the pomade in the dispenser.

A recent trend in the cosmetic industry is the development of wear-resistant, silicone-based lipsticks. The volume of actual product of such lipsticks and the diameter of the pomade are considerably reduced compared to conventional lipsticks. The smaller diameter of the pomade and the tendency of silicone formulations to be slippery and to shrink over time pose a unique problem in maintaining the pomade in a conventional lipstick dispenser that relies on the contact of the pomade against the inside surface of the holding cup. Furthermore, silicone-type lipsticks when pressed or inserted in the cup tend to become crushed at the base which further weakens the attachment of the pomade base in the cup. To reduce such damage to the base, the pomade can be molded to have a diameter that steps down toward the base so that the base conforms with the diameter and shape of the cup. However, the disadvantage of a silicone-type lipstick with a stepped down base is that it is difficult to mold using current automatic processes in which the bullets are formed with straight sides to allow for ready demolding.

Attempts have been made to improve retention of cosmetic masses such as lipsticks in retractable dispensers. For example, U.S. Pat. No. 4,208,144 (Idec) and U.S. Pat. No. 4,983,059 (Holloway) disclose a dispenser made with a plurality of longitudinal rib-like structures on the inside surface of an elevator cup to assist in gripping the pomade and preventing it from shifting or becoming dislodged from the cup holder during use. U.S. Pat. No. 4,820,070 (Spatz) discloses ribs that are dovetail in cross-section and bite into the inserted cosmetic stick to prevent the stick from pulling away from the side wall of the pomade cup. However, none of these rib structures adequately and effectively retain a pomade in a cosmetic dispenser during use, particularly a silicone-based pomade.

SUMMARY OF THE INVENTION

Therefore, an object of the invention is to provide a mechanism that will receive and securely hold a cosmetic pomade, particularly a silicone-based pomade, within a cosmetic dispenser. Another object is to provide a carrier mechanism that can receive and hold pomades of varying diameters and configurations, and with little or no distortion or damage to the pomade. Yet another object is to provide a pomade carrier mechanism that will facilitate automated filling of a constant diameter pomade without significant damage to it.

These and other objects are achieved by the present invention which is directed to a carrier for holding a solid pomade made of a pasty material such as a lipstick or lip balm, within a cosmetic dispenser that extends and retracts the pomade for use. Also provided is a cosmetic dispenser incorporating the pomade carrier therein, and methods of dispensing a pomade and mounting a pomade in the carrier.

The present pomade carrier provides improved retention of a pomade over mechanisms that are presently used to contain and hold a pomade in a cosmetic dispenser. The pomade carrier is composed of at least two, preferably 3–6, prong-like blades disposed on and extending perpendicularly from the surface of a platform that are adapted to engage and hold the pomade on the carrier.

The blades have at least two blade members. The blades, in cross-section, can be in the shape, for example, of a "V", "↓", "W", "E", "Σ", or the like. The blades can be arranged on the platform such that one or more of the blade members will be inserted into a pomade that is placed onto the carrier. In a preferred arrangement, one blade member is disposed on the platform in a parallel orientation along the perimeter or peripheral edge, and a second blade member is positioned at an angle to the peripheral edge toward the center of the platform. The first blade member can be placed contiguous with the peripheral edge of the platform such that, when a pomade is placed onto the carrier, the second blade member cuts into the pomade, and the inner surfaces of the first blade member is placed against the surface of the pomade with relatively minimal insertion into the body of the pomade. The contact of the blades with the pomade does rinimal damage to the base of a pomade, and reduces shifting or dislodgment of the pomade from the cosmetic dispenser during use, particularly silicone-based cosmetic pomades.

The pomade carrier can be used in conjunction with a conventional cosmetic delivery device as known and used in the art. The working parts of such devices generally include a tubular base sleeve, a tubular member that has a helical groove on the inside surface and is disposed coaxially within the base sleeve, and a carrier for the pomade with a member that is disposed within the inside groove of the tubular member to drive the carrier up and down within the dispenser.

The present pomade carrier overcomes problems associated with conventional cosmetic dispensers that use a cup-type holder to receive and hold a pomade. Currently used cup holders can cause damage to the base of the pomade when it is pressed into the cup, and do not hold the pomade securely in the dispenser, particularly smaller diameter silicone-based lipsticks that are more slippery than conventional lipsticks and often become dislodged during use. The present pomade carrier advantageously minimizes damage to the base of a cosmetic pomade especially a silicone-based pomade, so that it will remain intact and more firmly attached and better retained on the carrier, and will not shift or become displaced during use.

BRIEF DESCRIPTION OF THE DRAWINGS

Throughout the following views, reference numerals will be used in the drawings, and the same reference numerals will be used throughout the several views and in the description to indicate same or like parts of the invention.

FIG. 1 is a front perspective view of a conventional cosmetic dispenser;

FIG. 2 is a cross-section view of the assembled dispenser of FIG. 1 along line 2—2, showing the pomade carrier of the present invention assembled in the dispenser;

DETAILED DESCRIPTION OF THE PREFERRED EMBODIMENT

The invention will be better understood and its advantages appreciated from the following description. The term "pomade" as used herein includes a cosmetic such as a lipstick, lip balm or cosmetic concealer, or other solid, pasty material. The pomade can be in the form of a bullet, stick, bar, tube, column, or other like structure.

Figure 3:
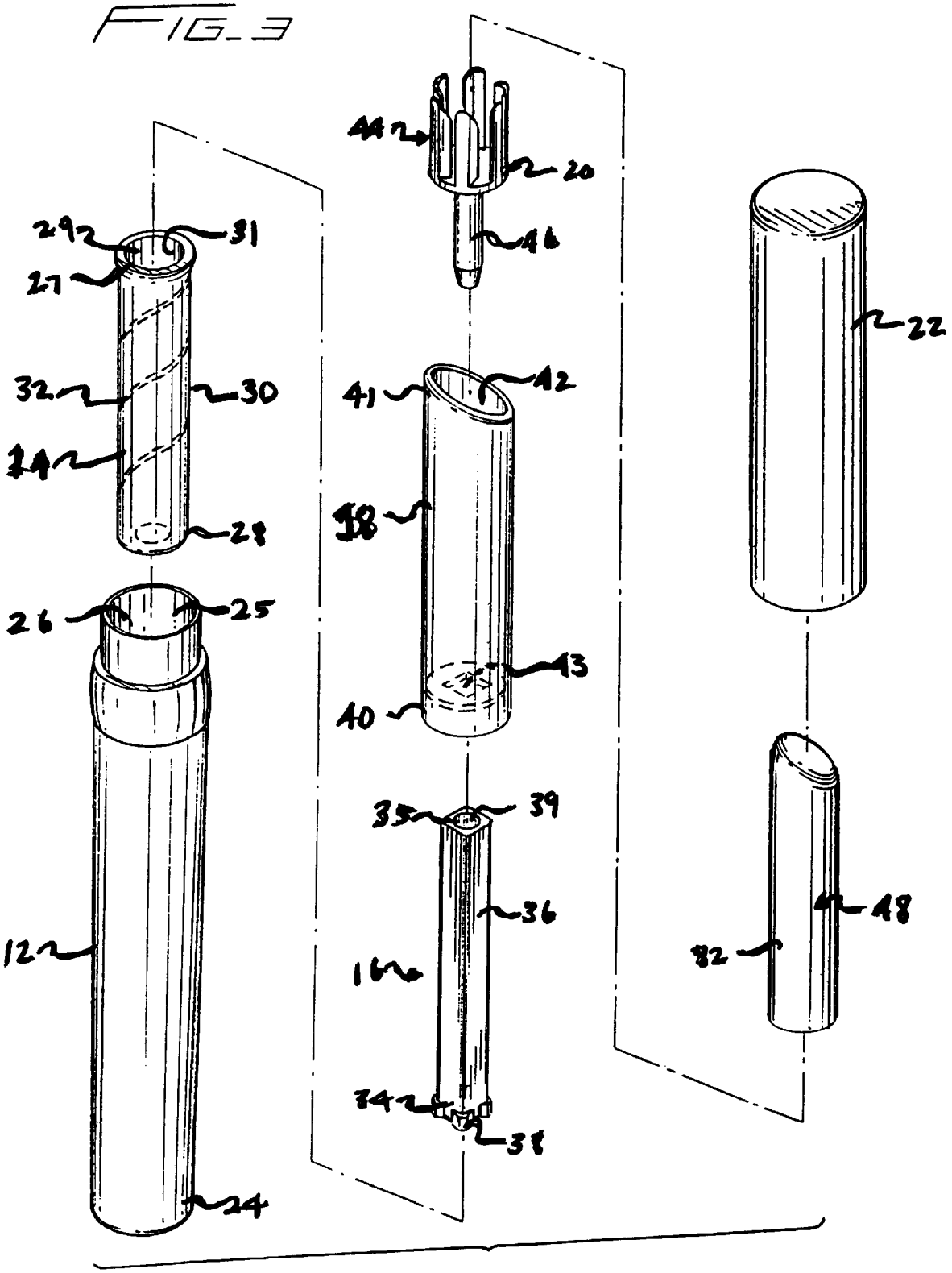
FIG. 3 is a front perspective exploded view of the principal elements of the dispenser of FIG. 1 with the pomade carrier of the present invention incorporated therein.

Referring now to the drawings, an embodiment of a cosmetic dispenser, generally designated with the numeral 10, that is composed of a known mechanism for extending and retracting a cosmetic pomade incorporating the pomade carrier of the invention, is shown in assembled front perspective and cross-sectional views in FIGS. 1 and 2, and in exploded form in FIG. 3.

It is understood that the pomade carrier can be incorporated into a variety of cosmetic dispensers to dispense a pomade. A typical cosmetic dispenser is generally composed of a tubular sleeve that contains a cup for holding the cosmetic pomade. The cup is movable along a spiral-shaped groove or track located on the inside surface of a tubular member disposed within the sleeve. The pomade in the cup is extended and retracted from the opening of the sleeve by twisting the tubular sleeve or other member to cause the cup to move up and down along the track in the dispenser.

The cosmetic dispenser 10 depicted in FIGS. 2 and 3, includes a cylindrical base sleeve 12, a tubular member 14, a driver shaft member 16, a nose sleeve 18, the pomade carrier 20, and a cap 22. The tubular base sleeve 12 has a first end 24, a second (open) end 25, and a bore 26. The tubular member 14 is sized to snap-fit into the base sleeve 12, and has first and second ends 27, 28, with a bore 29 therethrough, an outer surface 30, and an inner surface 31 having a helical- or spiral-shaped groove or track 32. The driver shaft member 16 has first and second ends 34, 35, and a shaft portion 36. The first end 34 includes an extension(s) 38 adapted to be inserted into and travel along the track 32 of the tubular member 14. The second end 35 includes an aperture 39 to receive and maintain the pomade carrier 20 therein. The tubular nose sleeve 18 has a first end 40 and a second (open) end 41, and a bore 42 therethrough. The first end 40 includes an opening 43 sized to receive the shaft 36 of the driver shaft member 16 therethrough into the bore 42. The pomade carrier 20 is disposed within the bore 42 of the nose sleeve 18, and includes vertical blade members 44 and a mating fastener 46 that is adapted for insertion into the aperture 39 of the driver shaft 16. A removable cap 22 fits over the nose sleeve 18 and onto the end 25 of the base sleeve 12.

When the base sleeve 12 is rotated about the nose sleeve 18, the extensions 38 of the driver shaft 16 moves in a linear fashion along the spiral track 32 of the tubular member 14. This causes the pomade carrier 20 to move up and down in the dispenser 10, and extend or retract a pomade 48, mounted on the pomade carrier 20 through the open end 41 of the nose sleeve 18.

It is understood that the pomade carrier 20 can also be mounted in a dispenser (not shown) that does not include a mechanism that operates to extend and retract the pomade carrier for dispensing the pomade. For example, the pomade carrier 20 can be mounted inside a housing such as the hollow, tubular sleeve 12, and a pomade 48 can be mounted on the stationary pomade carrier 20 and dispensed directly without being extended or retracted within the housing.

The pomade carrier 20 can be mounted in any conventional extension and retraction mechanism such as those described in U.S. Pat. No. 4,983,059 (Holloway), U.S. Pat. No. 4,208,144 (Idec), and U.S. Pat. No. 4,820,070 (Spatz), the disclosures of which are incorporated by reference herein. The pomade carrier 20 can also be mounted in a mechanism as described in U.S. patent application Ser. No. 08/767,943, filed Dec. 17, 1996, and entitled "Mechanism for Extending and Retracting a Cosmetic Pomade," the disclosure of which is incorporated by reference herein.

Figure 4:
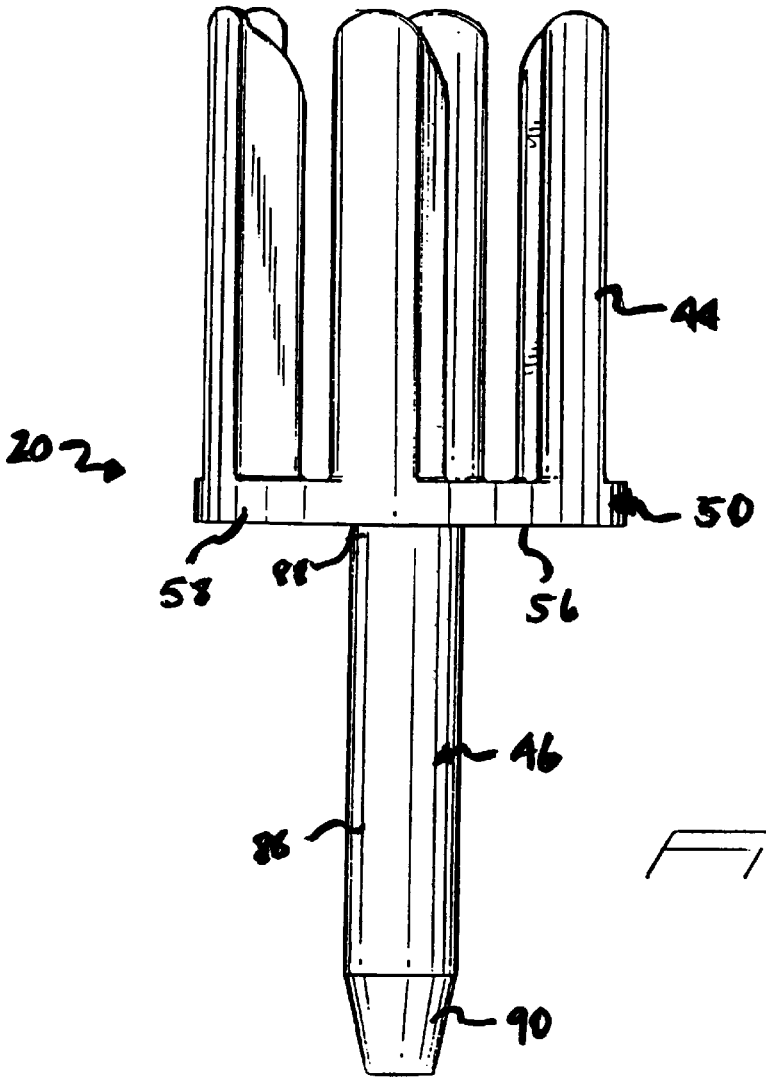
FIG. 4 is a side elevational view of one embodiment of the pomade carrier of the present invention.

As shown in detail in FIG. 4, the pomade carrier 20 includes two or more vertical blades 44 extending from a platform 50 that are adapted to engage and hold the pomade 48 on the carrier. The platform 50 of the pomade carrier 20 has a first surface 54, a second surface 56, and an outside edge or perimeter 58.

Figure 6:
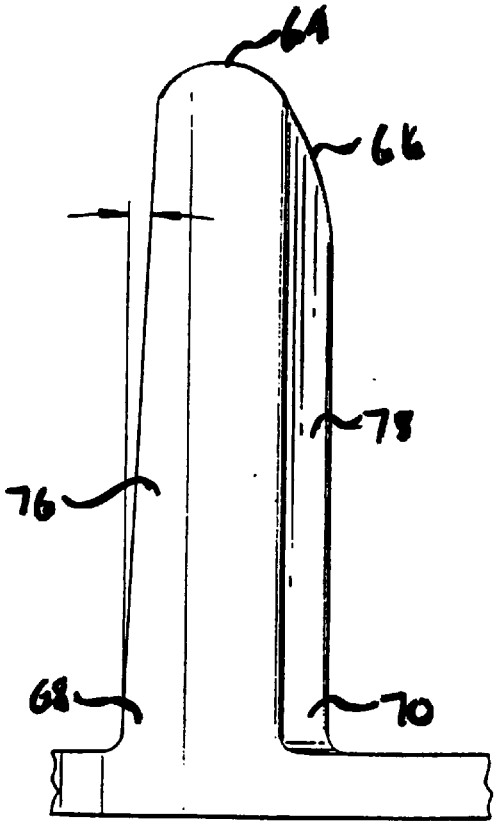
FIG. 6 is a side elevational view of a blade of the pomade carrier of FIG. 4.
Figure 7:
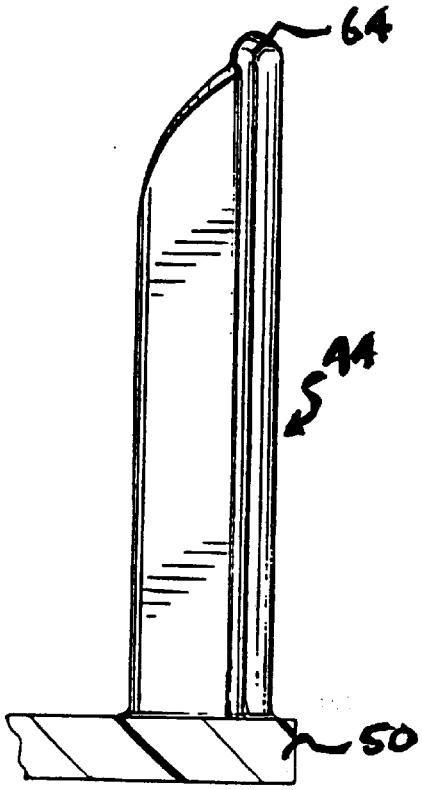
FIG. 7 is a cross-sectional view of the pomade carrier of FIG. 5 along line 7—7.

The blades 44 are elongate, prong-like extensions or spikes having at least two blade members. The blades can be shaped, for example, as a "V", "↓", "W", "E", "Σ", and the like. In a preferred embodiment, the blades are V-shaped in cross-sectional view, as best viewed in FIGS. 5–7, each blade 44 having a first and a second blade member 60, 62.

The blade members 60, 62 are juxtaposed with respect to each other and arranged on the platform 50 so that the pomade 48, when placed onto the carrier, is firmly secured and will not become dislodged during use nor pull away from the blades 44 as shrinkage occurs. Shrinkage and breakage are particular with silicone lipsticks, and the blades 44 are angled such that, when they are inserted into or deployed around the pomade 48, they will not break up the defined mass nor fragment the sides of the pomade.

Figure 5:
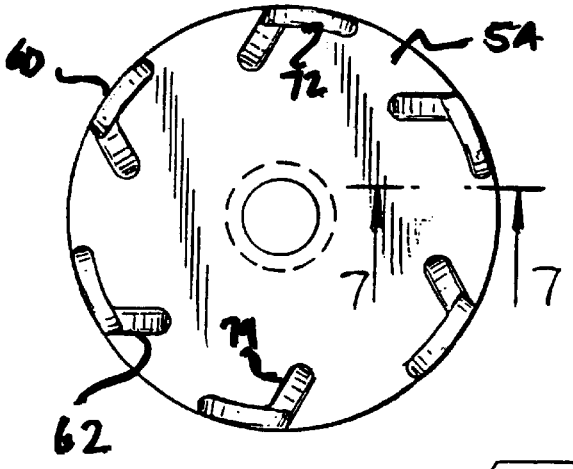
FIG. 5 is a top plan view of the pomade carrier of FIG. 4.

Preferably, at least two blade members are juxtaposed at an angle of less than about 180° and greater than about 40° with respect to each other, preferably at an about 45–1750° angle, more preferably at an about 100–140° angle, with a most preferred angle of about 120°. In the arrangement of the blades 44 on the platform 50 as shown in FIG. 5, it is preferred that there is an angle of at least about 5° between the blade member 62 and the peripheral edge 58 of the platform 50 to avoid fragmenting the sides of the pomade, more preferably an about 40–80° angle, with a preferred angle 9 of about 60°. It is further preferred that the arrangement of the blades on the platform 50 is such that the angle of insertion of the blade member 62 into the pomade mass 48 is less than or greater than 90° to firmly retain and reduce shifting of the pomade 48 on the carrier 20.

The blade members 60, 62 have an end portion 64, 66, a base portion 68, 70, an inner surface 72, 74, and an outer surface 76, 78, respectively. The blades 44 are attached along the base portions to the first surface 54 of the platform 50 and project perpendicularly from the platform. It is preferred that a blade 44 is arranged on the platform 50 such that the first blade member 60 is in a parallel orientation to the peripheral edge 58 of the platform 50, preferably contiguous with the peripheral edge 58, as shown with the V-shaped blade in FIG. 5. The second blade member 62 of the blade 44 is oriented at an angle to the first blade member 60 and to the peripheral edge 58 of the platform 50. The second blade member 62 is preferably directed toward but not through the center 80 of the platform, preferably at an angle of about 25–45° to the centerline of the platform. The engagement of blade members 62 with the pomade 48 at an angle that does not intersect with the central axis of the pomade 48 allows for shrinkage of the lipstick mass due to drying without allowing the mass to pull away from the blades. The blades 44 are preferably spaced uniformly or equidistant from each other around the peripheral edge 58 of the platform 50. The pomade carrier 20 is composed of two or more blades 44, preferably 3–6. In a preferred embodiment of the present invention and as shown in FIGS. 4 and 5, the pomade carrier 20 has six blades 44.

In the arrangement shown in FIG. 5, as the pomade 48 is placed onto the pomade carrier 20, the second blade member 62 of the blade 44 becomes inserted or embedded into the base 80 of the pomade 48. Although the first blade member 60 of the blade 44 can be placed on the platform 50 to also be inserted into the body of the pomade 48, it is preferred that the first blade member 60 is positioned so that it is flush against or contiguous with the peripheral edge 58 of the platform 50, as shown, with that arrangement of the blades 44 on the platform, when the pomade 48 is placed onto the pomade carrier 20, the second blade member 62 of the blade 44 is inserted into the base 80 and the shaft 82 of the pomade 48, and the inner surface 72 of the first blade member 60 is placed against the exterior surface of the shaft 82 of the pomade 48 with minimal insertion into the base 80 and the shaft 82 of the pomade 48. This cooperative action of the two blade members 60, 62 of the blades 44 effectively secures the pomade 48 on the carrier 20 such that there is little or no displacement or movement of the pomade either vertically or laterally during use.

As seen in FIG. 4, the pomade carrier 20 includes a mating fastener 46 that extends from the second surface 56 of the platform 50 to secure the pomade carrier 20 to the drive shaft member 16. As shown, a shaft portion 86 of the mating fastener 46 has a first end 88 that is attached to the second surface 56 of the platform 50, and a second end 90 that is adapted to be mounted (e.g., snap-fit) into an aperture 39 in the end 35 of the drive shaft member 16. It is understood, however, that the pomade carrier 20 can also be mounted onto the drive shaft 16 by adhering the second surface 56 of the platform 50 directly onto the end 35 of the shaft 16 by welding, molding, or with a suitable adhesive.

As depicted, the shaft portion 36 of the drive shaft member 16 includes an extension(s) 38 that is adapted and sized to be inserted into the spiral track 32 of the tubular member 14. In addition, contact between the extension 38 and the end 40 of the nose sleeve 18 prevents the drive shaft 16 from passing through the opening 43 so that the attached pomade carrier 20 is secured within the central bore 42 of the nose sleeve 18.

The pomade carrier 20 and other parts of the dispenser can be molded from a plastic material by injection molding, compression molding or other like technique known and used in the art. The outer surfaces of the base sleeve 12, nose sleeve 18, and the cap 22 are viewed by the user and can be colored or decorated as desired for aesthetic enhancement of the pomade dispenser 10.

To assemble the pomade carrier 20 in the dispenser 10, the drive shaft 16 is inserted through the opening 43 of the nose sleeve 18 and into the bore 42. The pomade carrier 20 is then inserted through the open end 41 of the nose sleeve and attached to the drive shaft member 16. In the depicted embodiment, the end 90 of the mating fastener 46 is snap-fit into the aperture 39 of the drive shaft 16. The tubular member 14 is secured (e.g., snap-fit) into the bore 26 of the base sleeve 12. The drive shaft 16 is then inserted through the open end 28 of the guide member 14 and the extensions 38 inserted into the spiral track 32. The end 40 of the nose sleeve 18 is then secured to the base sleeve 12.

A cosmetic pomade 48 can be loaded into the cosmetic dispenser 10 by inserting the pomade 48 through the open end 41 of the nose sleeve 18 until the base 80 is firmly engaged with the blades 44 of the pomade carrier 20. At least one blade member of each blade 44 is inserted into the pomade mass 48. The pomade 48 is preferably mounted in the dispenser 10 with the carrier 20 in a retracted position, and the cap 22 placed on the device.

In operation, the cosmetic dispenser 10 extends and retracts the cosmetic pomade 48 in a manner similar to conventional dispensing mechanisms. The nose sleeve 18 can be firmly held in a stationary manner, and the base sleeve 12 twisted to cause the drive shaft 16 and the pomade carrier 20 to move up and down along the spiral track 32 of the tubular member 14, and dispense or retract the pomade 48 depending on the direction of rotation. The pomade carrier 20 is particularly usefull for gripping or holding a pomade composed of a silicone-based formulation, for example, silicone-based lipsticks.

The invention has been described by reference to detailed examples and methodologies. These examples are not meant to limit the scope of the invention. Variation within the concepts of the invention are apparent to those skilled in the art. The disclosures of the cited references throughout the application are incorporated by reference herein.

What is claimed is:

1. A carrier for a pomade of a solid, pasty material, comprising: a platform having a first surface, a second surface, and a peripheral edge; and at least two blades disposed on and extending perpendicularly from the first surface of the platform, and adapted to engage and hold the pomade on the carrier;

each of the blades being spaced apart from each other and comprising a one piece blade defining at least first and a second blade members, wherein each of the blades is V-shaped, ↓-shaped, W-shaped, E-shaped, Σ-shaped, or a combination thereof when viewed in a direction transverse to the first surface of the platform, wherein tops of the blade members merge substantially smoothly with one another.

2. The pomade carrier according to claim 1, wherein the blades are uniformly spaced along the peripheral edge of the platform.

3. The pomade carrier according to claim 1, wherein at least one blade member of each blade is disposed on the platform to be inserted into a pomade that is placed onto the carrier.

4. The pomade carrier according to claim 3, wherein the blades are disposed on the platform such that the first blade member of each blade is in a parallel orientation along the peripheral edge, and the second blade member is at an angle to the peripheral edge.

5. The pomade carrier according to claim 4, wherein the second blade member is at an angle to the first blade member of about 45° to less than about 180°.

6. The pomade carrier according to claim 4, wherein the blades are disposed on the platform such that the first blade member of each blade is contiguous with the peripheral edge of the platform.

7. The pomade carrier according to claim 1, further comprising: a mating fastener extending from the second surface of the platform for securing the pomade carrier in a cosmetic dispenser.

8. The pomade carrier according to claim 7, wherein the mating fastener is adapted to be mounted onto a shaft member operable to move the pomade carrier within the cosmetic dispenser.

9. A carrier of claim 1, wherein each of the blades is V-shaped.

10. A carrier of claim 1, wherein each of the blades is V-shaped with a first and a second blade member;

the blades being spaced apart from each other and attached to the platform such that the first blade members are contiguous with the peripheral edge, and the second blade members are at an angle to the peripheral edge.

11. A carrier for a pomade of a solid pasty material, comprising: a platform having at least two blades disposed thereon and extending perpendicularly from a first surface of the platform for engaging and holding the pomade on the carrier, each of the blades having at least two blade members;

the blades being spaced apart from each other and comprising a one piece blade attached to the platform such that a first blade member of each blade is substantially contiguous with the peripheral edge, and a second blade member is at an angle to the peripheral edge, wherein each of the blades is V-shaped, ↓-shaped, W-shaped, E-shaped, Σ-shaped, or a combination thereof when viewed in a direction transverse to the first surface of the platform, wherein tops of the blade members merge substantially smoothly with one.

12. A method of dispensing a pomade, comprising:

(a) mounting a carrier as defined in claim 11 in a dispensing device having a hollow sleeve housing, wherein each of the blades comprises a one piece blade defining V-shaped, ↓-shaped, W-shaped, E-shaped, Σ-shaped, or a combination thereof when viewed in a direction transverse to a base;

(b) mounting the pomade in the carrier, wherein the carrier maintains the pomade therein by engaging the pomade with the blades; and (c) manipulating the dispenser to expose the pomade.

13. The method according to claim 12, wherein the dispensing device comprises a mechanism operable to extend and retract the pomade carrier within the sleeve housing.

14. The method according to claim 13, further comprising:

moving a moveable member along a track to extend and retract the pomade carrier within the device.

15. The method according to claim 14, wherein the sleeve housing comprises tubular base and nose sleeves each having central bores, with the nose sleeve rotatably disposed within the base sleeve.

16. The method according to claim 15, further comprising: twisting the nose sleeve relative to the base sleeve to dispense the pomade.

17. A method of mounting a pomade having a base, a shaft and an outer surface, in a cosmetic dispenser, comprising:

(a) providing a carrier as defined in claim 11 that is mounted in a hollow sleeve housing of a dispensing device, wherein each of the blades comprises a one piece blade defining a V-shaped, ↓-shaped, W-shaped, E-shaped, Σ-shaped, or a combination thereof when viewed in a direction transverse to a base; and (b) placing the pomade in the carrier, wherein the carrier maintains the pomade therein by engaging the pomade with the blades.

18. The method according to claim 17, wherein the pomade carrier comprises a platform having a first surface, a second surface, and a peripheral edge; and each of the blades have a first and a second blade member; and the blades are disposed on and extend perpendicularly from the first surface of the platform with the first blade member contiguous with the peripheral edge, and the second blade member at an angle to the peripheral edge; and wherein at least the second blade members are inserted into the pomade.

19. The method according to claim 18, further comprising: inserting the second blade members into the pomade, and placing the inner surfaces of the first blade members against the pomade with minimal insertion therein.

20. A carrier for holding a pomade, comprising:

a base; and at least two blades extending upwardly from the base, wherein the blades restrainingly are spaced apart from each other and are adapted to engage an inserted pomade against a force tending to remove the pomade from the base, wherein each of the blades comprises a one piece blade which is V-shaped, ↓-shaped, W-shaped, E-shaped, Σ-shaped, or a combination thereof when viewed in a direction transverse to the base, each blade comprising blade members whose tops merge substantially smoothly with one another.

21.The carrier according to claim 20, wherein the blades each comprise at least two blade members juxtaposed at an angle of less than about 180° with respect to each other.

22. The carrier according to claim 21, wherein the blade members are juxtaposed at an angle of about 45–175° with respect to each other.

23. The carrier according to claim 22, wherein the blade members are juxtaposed at an angle of about 100–140° with respect to each other.

24. A device for dispensing a pomade of a solid, molded, pasty material, comprising:

a) a tubular base sleeve having a central bore;

b) a tubular nose sleeve having a central bore therethrough, and rotatably disposed within the base sleeve;

c) a tubular member disposed coaxially within the base sleeve having an inner surface with a helical-shaped track therein;

d) a shaft member having a first end with an extension for engaging the track in the tubular member and a second end disposed within the bore of the nose sleeve; and e) a carrier for the pomade attached to the shaft member, comprising:

(i) a platform having a first surface, a second surface, and a peripheral edge; and (ii) at least two blades adapted to engage and hold the pomade on the carrier, and extending perpendicularly from the first surface of the platform, said blades being spaced apart from each other, wherein each of the blades comprises a one piece blade defining a V-shaped, ↓-shaped, W-shaped, E-shaped, Σ-shaped, or a combination thereof when viewed in a direction transverse to the first surface of the base, each blade comprising blade members whose tops merge substantially smoothly with one another.

25. The dispenser according to claim 24, wherein the pomade carrier further comprises:

(iii) a mating fastener extending from the second surface of the platform and adapted to mount the pomade carrier onto the second end of the shaft member.

26. The dispenser according to claim 24, further comprising a pomade mounted on the pomade carrier.

27. The dispenser according to claim 26, wherein the pomade is a silicone-based lipstick.

28. A device for dispensing a pomade of a solid, molded, pasty material, comprising: a sleeve housing having a carrier for the pomade disposed therein; the pomade carrier comprising:

(a) a platform having a first surface, a second surface, and a peripheral edge; and (b) at least two blades disposed on and extending perpendicularly from the first surface of the platform, said blades being spaced apart from each other, and adapted to engage and hold the pomade on the carrier; each blade having at least two blade members, wherein each of the blades comprises a one piece blade defining a V-shaped, ↓-shaped, W-shaped, E-shaped, Σ-shaped, or a combination thereof when viewed in a direction transverse to the first surface of the platform, wherein tops of the blade members merge substantially smoothly with one another.

29. The dispensing device according to claim 28, further comprising a mechanism operable to extend and retract the pomade carrier within the sleeve housing.

30. The dispensing device according to claim 29 wherein the mechanism comprises:

a tubuler member having an inner surface with a helical-shaped track therein; and a member movably disposed in the track of the tubular member and attached to the pomade carrier, which when moved along the track, operates to extend and retract the pomade carrier within the device.

* * * * *

UNITED STATES PATENT AND TRADEMARK OFFICE

CERTIFICATE OF CORRECTION

PATENT NO. : 6,293,721 B1
DATED : September 25, 2001
INVENTOR(S) : Clark Bow et al.

It is certified that error appears in the above-identified patent and that said Letters Patent is hereby corrected as shown below:

Column 7,
Line 36, after "one" insert -- another --.

Column 9,
Line 1, change "base" to -- platform --.

Column 10,
Line 14, change "tubuler" to -- tubular --.

Signed and Sealed this

Twenty-eighth Day of May, 2002

*Attest:*

*Attesting Officer*

JAMES E. ROGAN
*Director of the United States Patent and Trademark Office*